US007182824B2

(12) United States Patent
Andoh et al.

(10) Patent No.: US 7,182,824 B2
(45) Date of Patent: Feb. 27, 2007

(54) METHOD OF MANUFACTURING ZINC ALLOY INGOT

(75) Inventors: Atsushi Andoh, Sakai (JP); Atsushi Komatsu, Kyoto (JP); Katsuyuki Takezaki, Sakai (JP); Yasutaka Kawaguchi, Tokyo (JP); Yasuhiro Yamamoto, Tokyo (JP); Ryuuji Ninomiya, Ageo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 220 days.

(21) Appl. No.: 10/464,072

(22) Filed: Jun. 17, 2003

(65) Prior Publication Data

US 2004/0256033 A1 Dec. 23, 2004

(51) Int. Cl.
*C22F 1/16* (2006.01)

(52) U.S. Cl. ..... 148/538

(58) Field of Classification Search ..... 148/519, 148/514, 441, 705, 538; 420/519, 514, 513
See application file for complete search history.

(56) References Cited

U.S. PATENT DOCUMENTS 3,505,043 A 4/1970 Lee et al.

4,439,397 A * 3/1984 Dreulle ..... 420/519

FOREIGN PATENT DOCUMENTS

| | | |
|---|---|---|
| JP | 58-177446 | 10/1983 |
| JP | 10-226865 | 8/1998 |
| JP | 10-306357 | 11/1998 |
| JP | 2002-172457 | * 6/2002 |

* cited by examiner

*Primary Examiner*—Roy King
*Assistant Examiner*—Kathleen McNelis
(74) *Attorney, Agent, or Firm*—The Webb Law Firm

(57) ABSTRACT

A molten zinc alloy, which contains 4–22 mass % Al, 1–7 mass % Mg and optionally one ore more of Ti, B and Si at very small ratios, is held at a temperature $T_h$ higher than (a solidification-beginning temperature $T_{s.b.}$+85° C.) for homogenization, and then cooled down to a temperature $T_c$ equal to ($T_{s.b.}$+20–65° C.). After the molten alloy is poured in a mold, it is naturally cooled and solidified to an ingot, while its upper part is being heated. Once an upper surface of the zinc alloy in the mold begins to solidify, it is optionally cooled with water. The produced ingot has a structure without cracks or cavities, so that it is safely fed to a molten pool for replenishment.

5 Claims, 1 Drawing Sheet

METHOD OF MANUFACTURING ZINC ALLOY INGOT

BACKGROUND

The present invention relates to a method of manufacturing a zinc alloy ingot, which has a relatively flat upper surface without cracks or cavities, suitable for use as a replenishment to a molten pool for hot-dip coating a steel strip.

A steel sheet coated with a Zn—Al—Mg alloy plating layer exhibits excellent corrosion-resistance, compared with conventional Zn-coated steel sheets.

There have been proposed various methods so far for formation of the Zn—Al—Mg alloy plating layer. For instance, U.S. Pat. No. 3505043 discloses use of a molten zinc alloy pool containing 3–17 mass % Al and 1–5 mass % Mg. JP 58-177446A discloses use of a molten zinc alloy pool containing 3–25 mass % of Al, 0.05–2 mass % of Mg, 0.005–0.1×Al % of Si and up to 0.02 mass % of Pb. JP 10-226865A discloses a steel sheet hot-dip coated with a plating layer consisting of 4.0–10.0 mass % Al, 1.0–4.0 mass % Mg and the balance being Zn except inevitable impurities. JP 10-306357A discloses a plating layer consisting of 4.0–10.0 mass % Al, 1.0–4.0 mass % Mg, 0.002–0.1 mass % Ti, 0.001–0.045 mass % B and the balance being Zn except inevitable impurities.

The Zn—Al—Mg plating layer is improved in corrosion-resistance and external appearance by controlling a temperature of a molten pool and a cooling rate of a hot-dip coated steel strip, as disclosed in JP 10-226865A and JP 10-306357A.

In order to continuously manufacture a steel strip hot-dip coated with a Zn—Al—Mg plating layer in an industrial scale, a molten pool is periodically replenished by feeding Zn—Al—Mg alloy ingots of the same composition to the molten pool at predetermined intervals in correspondence with consumption of the Zn—Al—Mg alloy.

The Zn—Al—Mg ingot for the purpose shall have a structure without cracks and cavities and an upper surface with a dent sufficiently small in size. If there are cracks or cavities in the ingot, water unfavorably invades into the cracks or cavities during transportation or storage of the ingot. The wet ingot causes very dangerous steam explosion, when it is immersed in the molten pool held at an elevated temperature. The ingots are ordinarily piled up together for transportation or storage. Ingots, which are significantly dented at upper surfaces, can not be piled up together in stationary state. Collapse of piled-up ingots are also very dangerous.

However, a Zn—Al—Mg ingot manufactured by a conventional process is likely to involve cracks and cavities therein, and a big-size dent is often formed on its upper surface.

SUMMARY OF THE INVENTION

The present invention aims at provision of a zinc alloy ingot, which has a structure suitable for safe replenishment of a molten pool and an upper surface with such a relatively small dent that it can be stationarily piled up for transportation or storage.

The inventors have researched and examined solidification phenomena of a Zn—Al—Mg alloy, and concluded that generation of cracks and cavities is caused by co-presence of liquid and solid phases over a broad temperature range from the beginning to completion of solidification. Co-presence of liquid and solid phases is typically noted in a tertiary system,; which forms a tertiary $Al/Zn_2/Mg$ or $Al/Zn/Zn_{11}Mg_2$ eutectic structure. Cracks or cavities are accelerated generated under inadequate cooling conditions.

Generation of cracks and cavities can be inhibited by specified heat-treatment, i.e. homogenization of a molten Zn—Al—Mg alloy, cooling down to a specified casting temperature and then spontaneous cooling in a mold with top-heating. A dent on an upper surface of an ingot is also reduced in size by the heat-treatment.

According to the inventive method, a molten zinc alloy, which contains 4–22 mass % Al and 1–7 mass % Mg, is homogenized by holding it at a temperature $T_h$ higher than (a solidification-beginning temperature $T_{s.b.}$+85° C.). The homogenized molten alloy is cooled down to a temperature $T_c$ equal to ($T_{s.b.}$+20–65° C.) and poured in a mold. The molten alloy is then naturally cooled and solidified in the mold, while its upper part is being heated (hereinafter referred to as "top-heated"). An upper surface of the molten alloy in the mold may be cooled with water, when its solidification begins.

PREFERRED EMBODIMENTS OF THE INVENTION

Figure 1:
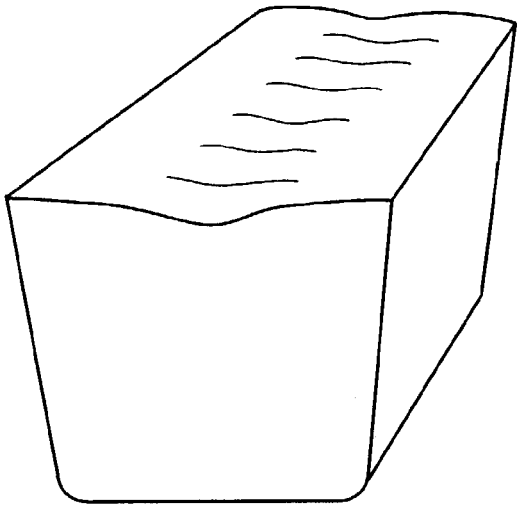
FIG. 1 is a perspective view illustrating a cut plane of an ingot manufactured by the inventive method.

Other features of the present invention will be clearly understood from the following explanation.

A molten zinc alloy consisting of 4–22 mass Al, 1–7 mass % Mg and the balance being Zn except inevitable impurities is used in the inventive method. The specified composition of the zinc alloy is suitable as a molten alloy pool for hot-dip coating a steel sheet with a Zn—Al—Mg alloy plating layer excellent in corrosion-resistance, as disclosed in the above-mentioned publications in U.S. and Japan. The zinc alloy may further contain other components for improvement properties of the Zn—Al—Mg plating layer. For instance, Ti and/or B inhibits generation and growth of $Zn_{11}Mg_2$. Si inhibits generation of a hard brittle Fe—Al alloy layer and improves workability of a plating layer. These elements are effective even at small ratios, i.e. 0.002–0.1 mass % Ti, 0.001–0.5 mass % B and 0.005–2 mass % Si.

The molten zinc alloy is prepared by melting a zinc alloy having the specified compositions, or by melting a zinc alloy having nearly the same composition and then adding other components as single metals or mother alloys. The molten zinc alloy having the specified composition may be also prepared by melting a zinc alloy containing at least one of Al, Mg, Ti, B and Si, and then adding other components as single metals or mother alloys to the molten zinc alloy. Addition of Al, Mg and optionally at least one of Ti, B and Si as individual metals or mother alloys to molten zinc is of course applicable to preparation of the molten zinc alloy having the specified composition.

The specified composition has the unfavorable tendency that precipitation of a tertiary $Al/Zn_2/Mg$ or $Al/Zn/Zn_{11}Mg_2$ eutectic structure is promoted during casting. Precipitation of the eutectic structure means co-presence of liquid and solid phases over a broad temperature range and local concentration of shrinkage stresses, which induce cracks and cavities. The effects of shrinkage stresses on generation of cracks and cavities are suppressed by controlling a homogenizing temperature $T_h$ and a casting temperature $T_c$ in relation with a solidification-beginning temperature $T_{s.b.}$ as well as cooling conditions of the molten alloy in a mold.

The molten alloy is homogenized at $T_h$. Since homogenization is accelerated at a higher temperature, the temperature $T_h$ is determined to a level higher than ($T_{s.b.}$+85° C.), preferably ($T_{s.b.}$+105° C.), more preferably ($T_{s.b.}$+125° C.). However, excess heating makes a difference bigger between $T_h$ and $T_c$, so as to necessarily requires an excess waiting time for casting. Excess heating of course consumes a large amount of energy.

The homogenized molten alloy is cooled down to a temperature $T_c$ higher by 20–65° C. than $T_{s.b.}$. If the molten alloy is cooled down to a temperature lower than ($T_{s.b.}$+20° C.), it becomes too viscous, resulting in generation of a large amount of scum and troubles in a casting process. If the molten alloy is cast at a temperature higher than ($T_{s.b.}$+65° C.) on the contrary, an ingot is unfavorably cracked regardless top-heating. Therefore, the molten alloy is cooled down to a temperature $T_c$ equal to ($T_{s.b.}$+20–65° C.), and then cast to an ingot.

The molten alloy, which is cooled down to $T_c$, is poured in a mold. A conventional mold is available. The molten alloy is cooled in the mold, while its upper part is being top-heated. The top-heating itself is a well-known method.

Due to combination of the homogenization, the controlled casting temperature and the top-heating as above-mentioned, a zinc alloy ingot is manufactured without generation of cracks and cavities. The produced ingot can be supplementally fed to a molten pool for hot-dip coating a steel strip without any troubles such as steam explosion. Furthermore, the ingot has an upper surface with a relatively small dent, so that it can be stationarily piled up without a fear of collapse.

The molten alloy is cooled in the mold, while its upper part is being top-heated. When an upper surface of the molten alloy begins to solidify, it is optionally cooled with water. Water-cooling effectively inhibits generation of cracks and cavities, and also reduces a dent on an upper surface of an ingot.

EXAMPLE 1

A molten zinc alloy was adjusted to the composition consisting of 6.0 mass % Al, 3.0 mass % Mg, 0.05 mass % Ti, 0.01 mass % B and the balance being Zn except inevitable impurities. Its solidification-beginning temperature $T_{s.b.}$ was 365° C. The molten alloy was homogenized by holding it at 500° C. The homogenized molten alloy was cooled down to a casting temperatures $T_c$, and poured in a mold by weight of about 850 kg. The casting temperatures $T_c$ was varied as shown in Table 1, so as to research effects of the casting temperatures $T_c$ on properties of an ingot.

After completion of pouring, the molten alloys Nos. 1, 2, 5 and 6 were naturally cooled in the mold, while their upper parts were being top-heated. The other zinc alloy Nos. 3 and 4 were naturally cooled as such in the mold without top-heating. An upper surface of the molten alloy No. 2 was cooled with water, when it begins to solidify in the mold.

Each ingot was cut to inspect presence of cracks or cavities. Results are shown in Table 1. In Table 1, the mark ◎ represents an excellent ingot for use as a replenishment to a hot-dip pool without any troubles, the mark ○ represents a good ingot, the mark Δ represents an ingot which shall be carefully immersed in a hot-dip pool, the mark X represents an ingot unsuitable for use as a replenishment to a hot-dip pool.

An upper surface of each ingot was also observed to evaluate a size of a dent.

Figure 2:
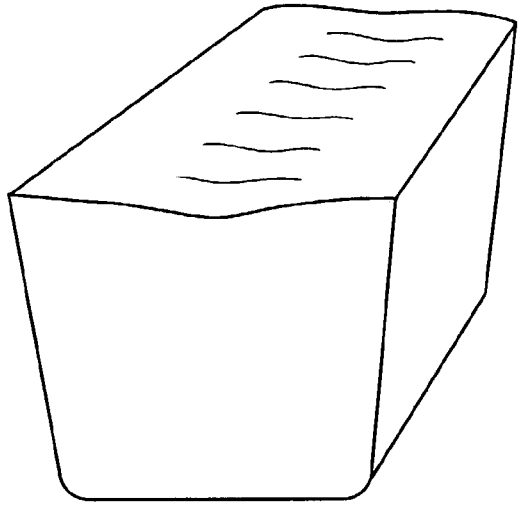
FIG. 2 is a perspective view illustrating a cut plane of another ingot manufactured by the inventive method.
Figure 3:
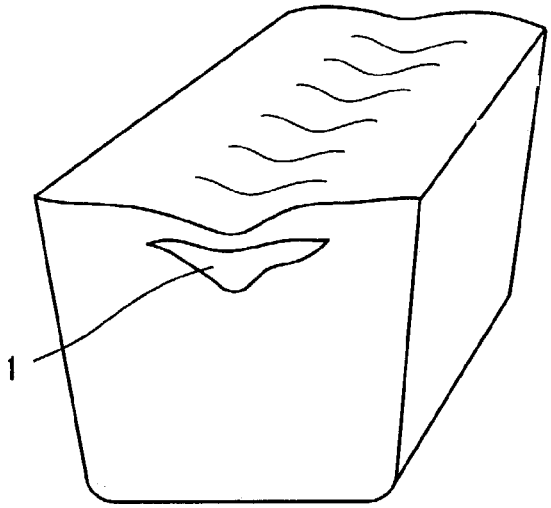
FIG. 3 is a perspective view illustrating a cut plane of an ingot manufactured by a comparative method.
Figure 4:
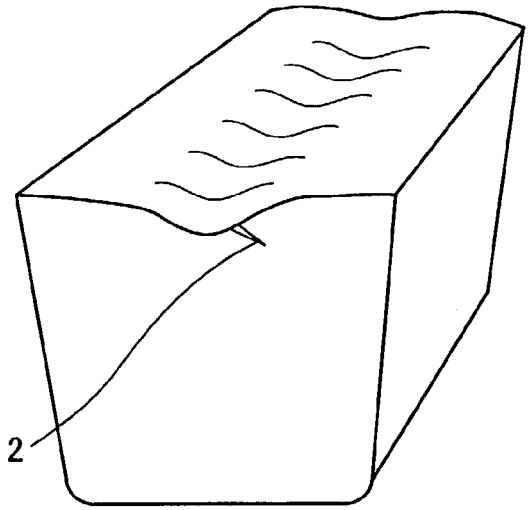
FIG. 4 is a perspective view illustrating a cut plane of another ingot manufactured by a comparative method.

The ingot No. 1 had a cut plane free from cracks and cavities, and its upper surface was slightly dented, as shown in FIG. 1. The ingot No. 2 had a cut plane free from cracks and cavities, and a dent on its upper surface was very small in size, as shown in FIG. 2. But, there was a big cavity 1 in the ingot No. 4 (FIG. 3), and cracks 2 were detected in the ingot No. 5 (FIG. 4).

TABLE 1

Effects Of Heat-Treatment On Properties Of Ingots

| | Inventive Examples | | Comparative Examples | | | |
|---|---|---|---|---|---|---|
| | 1 | 2 | 3 | 4 | 5 | 6 |
| Casting Temperature $T_c$ (° C.) | 420 | 440 | 460 | 430 | 430 | 440 |
| Top-Heating | yes | Yes | no | no | yes | yes |
| Water-Cooling Of Upper Surface | no | Yes | no | no | no | no |
| Presence Of Cracks | no | no | yes | no | yes | yes |
| Presence Of Cavities | no | no | | yes | no | |
| Relative Size Of Dent | middle | Small | big | big | big | big |
| Comprehensive Evaluation | ○ | ◎ | X | Δ | Δ | Δ |

Results shown in Table 1 and FIGS. 1–4 prove that the zinc alloy ingots Nos. 1 and 2 can be additionally fed to a molten pool for hot-dip coating a steel sheet under safe conditions, but it is dangerous to immerse the ingots Nos. 3–6 in the molten pool for replenishment.

EXAMPLE 2

Three molten zinc alloys A, B and C, each having composition shown in Table 2, were prepared. A solidification-beginning temperature $T_{s.b.}$ of each zinc alloy is shown in Table 2.

Each molten alloy was homogenized at a temperature $T_h$, cooled down to a casting temperature $T_c$, and then poured in a mold by weight of about 850 kg. After completion of pouring, some molten alloys were naturally cooled with top-heating, while the other molten alloys were naturally cooled as such without top-heating. Thereafter, some alloys were naturally cooled and solidified as such to ingots. The other alloys were cooled and solidified to ingots, under the condition that their upper surfaces were cooled with water when the upper surfaces began to solidify.

An external appearance and a cut plane of each produced ingot were observed to investigate effects of homogenization on properties and structures of the ingot. Cracks and cavities in the ingots together with size of dents on upper surfaces of the ingots were evaluated on the same standards as in Example 1.

Results are shown in Table 3, wherein the mark ○ represents a homogeneous structure, and the mark X represents a non-homogeneous structure.

TABLE 2

Zinc Alloy Used In Example 2

| Alloy Kind | Alloying Components (mass %) Al | Mg | Ti | B | Si | Zn | $T_{s.b.}$ (° C.) |
|---|---|---|---|---|---|---|---|
| A | 6.0 | 4.0 | — | — | — | bal. | 370 |
| B | 11.0 | 3.0 | — | — | 0.2 | bal. | 418 |
| C | 20.0 | 6.0 | 0.8 | 0.1 | 1.4 | bal. | 465 |

TABLE 3

Effects Of Heat-Treatment On Properties Of Ingots

| | Alloy Kind | $T_h$ (° C.) | $T_c$ (° C.) | top-heating | water-cooling of upper surface | Homogeneity Of molten alloy | cracks | Cavities | size of dent | evaluation |
|---|---|---|---|---|---|---|---|---|---|---|
| Cf. 5 | A | 430 | 400 | do | no | X | absent | absent | middle | X |
| Ex. 3 | A | 480 | 400 | do | no | ○ | absent | absent | middle | ○ |
| Ex. 4 | A | 480 | 420 | do | no | ○ | absent | absent | middle | ○ |
| Ex. 5 | A | 480 | 440 | do | do | ○ | absent | absent | small | ◎ |
| Cf. 6 | B | 510 | 450 | no | no | ○ | present | present | big | Δ |
| Ex. 6 | B | 510 | 450 | do | no | ○ | absent | absent | middle | ○ |
| Cf. 7 | B | 510 | 490 | do | no | ○ | present | absent | big | Δ |
| Ex. 7 | B | 510 | 490 | do | do | ○ | absent | absent | small | ◎ |
| Cf. 8 | C | 530 | 500 | do | no | X | absent | absent | middle | X |
| Ex. 8 | C | 570 | 500 | do | no | ○ | absent | absent | middle | ○ |
| Ex. 9 | C | 600 | 535 | do | do | ○ | absent | absent | small | ◎ |

$T_h$: a homogenizing temperature
$T_c$: a casting temperature

It is noted from the results in Table 3 that molten alloys Cf. 5 and 8 were insufficiently homogenized at $T_h$ lower than ($T_{s.b.}$+85° C.), so that the produced ingots were inappropriate for use as a replenishment to a hot-dip pool due to the uneven composition at every ingot or at every part of an ingot. When a molten alloy poured in a mold was naturally cooled as such without top-heating, cracks and cavities were present in the produced ingot, and an upper surface of the ingot was significantly dented, as noted in Cf. 6. When a molten alloy Cf. 7 was cast at $T_c$ higher than ($T_{s.b.}$+65° C.), a produced ingot was cracked during cooling in succession to top-heating, and its upper surface was significantly dented.

On the other hand, any of the zinc alloy ingots Ex. 3–9 according to the inventive method was free from cracks and cavities, so that it was safely immersed in a molten pool for replenishment without any troubles. Moreover, the ingot was stationarily piled up due to its upper surface with a relatively small dent.

According to the present invention as above-mentioned, generation of cracks and cavities in an ingot is inhibited by combination of homogenization, temperature-controlled casting and top-heating. The produced ingots can be supplementally fed to a molten pool for hot-dip coating a steel sheet without any troubles due to absence of cracks and cavities. Moreover, the ingots are transported or stored in a stationarily piled-up state, since their upper surfaces are relatively flat.

The invention claimed is:

1. A method of manufacturing a zinc alloy ingot, which comprises the steps of:

preparing a molten zinc alloy consisting of 4–22 mass % Al, 1–7 mass % Mg, optionally one or more of 0.002–1 mass % Ti, 0.001–0.5 mass % B and 0.005–2 mass % Si, and the balance being Zn except inevitable impurities;

holding said molten zinc alloy at a temperature higher by 85° C. or more than its solidification-beginning temperature for homogenization;

cooling said molten zinc alloy down to a temperature within a range of 20° C. or more but less than 65° C. more than said solidification-beginning temperature;

pouring said molten zinc alloy in a mold; and naturally cooling and solidifying said molten zinc alloy in the mold, while an upper part of said molten zinc alloy is being heated.

2. The manufacturing method defined in claim 1, wherein the molten zinc alloy is held at a temperature higher by 100° C. or more than the solidification-beginning temperature for homogenization.

3. The manufacturing method defined in claim 1, wherein the molten zinc alloy in the mold is further cooled with water at its upper surface, when said upper surface begins to solidify.

4. A method of manufacturing a zinc alloy ingot, which comprises the steps of:

preparing a molten zinc alloy consisting of 4–22 mass % Al, 1–7 mass % Mg, optionally one or more of 0.002–1 mass % Ti, 0.001–0.5 mass % B and 0.005–2 mass % Si, and the balance being Zn except inevitable impurities;

holding said molten zinc alloy at a temperature higher by 85° C. or more than its solidification-beginning temperature for homogenization;

cooling said molten zinc alloy down to a temperature within a range of 20° C. to 75° C. more than said solidification-beginning temperature;

pouring said molten zinc alloy in a mold;

heating an upper part of said molten zinc alloy being cooled in the mold; and cooling said upper part of said molten zinc alloy with water, when the upper surface of the molten zinc alloy beings to solidify.

5. The manufacturing method defined in claim 4, wherein the molten zinc alloy is held at a temperature higher by 100° C. or more than the solidification-beginning temperature for homogenization.

* * * * *